US005224791A

United States Patent [19]

Syak et al.

[11] Patent Number: 5,224,791

[45] Date of Patent: Jul. 6, 1993

[54] GLARE SCREEN

[75] Inventors: Charles W. Syak, Lost Tree Village, Fla.; Bud C. Sekella, Warren; Nick A. DiMargio, Canfield, both of Ohio

[73] Assignee: Syro Steel Company, Girard, Ohio

[21] Appl. No.: 892,582

[22] Filed: Jun. 3, 1992

[51] Int. Cl.[5] ..... E01F 9/00

[52] U.S. Cl. ..... 404/9; 256/13.1

[58] Field of Search ..... 404/9, 6; 256/13.1

[56] References Cited

U.S. PATENT DOCUMENTS 4,088,415 5/1978 Syak ..... 404/6

4,338,041 7/1982 Schumanski ..... 404/9

FOREIGN PATENT DOCUMENTS 1503847 3/1978 United Kingdom ..... 404/9

*Primary Examiner*—Andrew V. Kundrat

*Attorney, Agent, or Firm*—Trask, Britt & Rossa

[57] ABSTRACT

A light and vision blocking device structured of a hollow, tubular member having an attached flange for securing the device to a highway median barrier is disclosed. The device is a semi-flexible plastic device suited for impact absorption.

16 Claims, 5 Drawing Sheets

GLARE SCREEN

BACKGROUND OF THE INVENTION

1. Field

The instant invention relates to a light and vision blocking device or system for blocking light from oncoming traffic. The light-blocking device utilizes vertically-oriented, elongated members attached to the top surface of a concrete highway barrier.

2. State of the Art

Light-blocking devices of various types have been utilized top highway median barriers. Typical of such devices are those disclosed in U.S. Pat. No. 4,088,415 (Syak) and U.S. Pat. No. 4,338,041 (Schmanski). Another device is a metal screen.

Each of the existing systems has advantages and disadvantages. Metal screens are permanently damaged by rocks, impacting vehicles, overhanging cargo, etc. and present a physical barrier to personnel as well, which can impede work associated with temporary detours and the like.

An assessment of the state of the art as of about 1981 is set forth in the Schmanski patent. The system of Schmanski, however, also has certain disadvantages. It is designed exclusively as a modular system with thin fiberglass reinforced plastic (FGRP) slats which are attached by a pair of L-shaped brackets to a FGRP runner which is then attached to a concrete median barrier. The runner is intended to absorb (dissipate) vibrational energy caused by the thin slats being buffeted by the wind or when struck by flying objects, truck mirrors or objects protruding from vehicles.

Because these light-blocking devices are used frequently on temporary detours adjacent to repair or construction work, the thin slats of Schmanski present a hazard to workmen whenever such slats are dislodged and become flying projectiles. Also, when these FGRP slats are struck at speeds of 30 MPH and above, they tend to shred at the tips. The fluttering of these tips from wind gusts caused by vehicles, especially large trucks, can be distracting to drivers. Also, the modular construction of Schmanski requires the whole unit (module) to be removed in order to replace a single slat which has been dislodged. Also, since the Schmanski slats are flat and thin, wind gusts tend to affect them greatly, causing constant flexing and waving, which not only puts constant stress on the system but the waving of the blades causes a distraction to drivers. Additionally, the metal brackets of Schmanski tend to take a permanently bent shape when the slats are struck by a protruding object on a vehicle at speeds greater than 30 mph.

The blunt-ended foils of Syak have several advantages over the Schmanski device, such as safety in the event a foil is dislodged. Also, the Syak foil can be individually used. The Syak foil, because it is fastened with bolts through the sidewall, may exhibit a tendency for the bolts to tear out the bolt hole when the foil is struck.

SUMMARY OF THE INVENTION

A light and vision-blocking device structured of a hollow, tubular plastic member having an attached plastic flange suitable for securing the device to a highway median barrier with a minimum number of bolts has been invented. Preferably, the device is an elongated, aerodynamically-shaped, hollow tube having a substantially elliptical lateral cross-section and an integral flange having a substantially elliptical shape with a sufficient maximum width to accommodate a bolt hole on each side of the tube. While the light and Vision-blocking device of the instant invention has utility as a permanent installation for highway median barriers, it is especially useful for temporary barriers associated with construction projects, detours and the like.

BRIEF DESCRIPTION OF THE DRAWINGS

FIG 6(*b*) is an elevational, end-view of a FGRP base runner;

DETAILED DESCRIPTION OF THE PREFERRED EMBODIMENT

A light-blocking device and system has been invented which are simple to install, either individually or as a modular system. The devices are sturdy, aerodynamically-shaped, elongated, hollow tubes, preferably with a blunt (closed) top end and a flat flange, preferably as an integral part of the tube, at least partially, outwardly circumscribing the lower, open end of the tube.

The device is made of a semi-rigid plastic, typically a thermoplastic material which can be readily blow-molded to form a tough, integrally-formed (single-piece) element. The device could be extruded as a continuous tube, then capped and fitted with a flange having a snug fitting hub glued to the base of the hollow tube.

Figure 1:
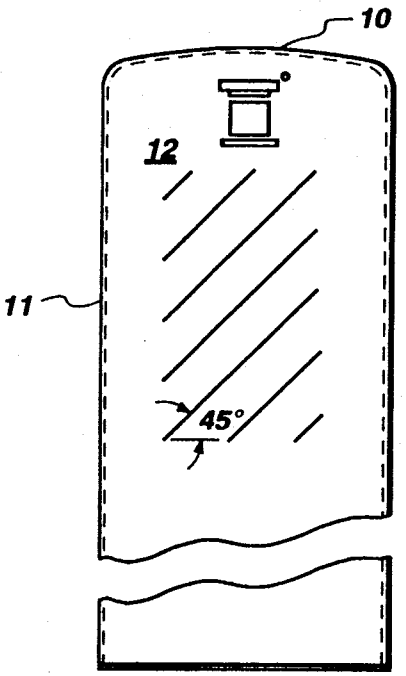
FIG. 1 is a front, elevational view of a flanged, light-blocking, hollow tubular device having an elliptical cross-section.
Figure 2:
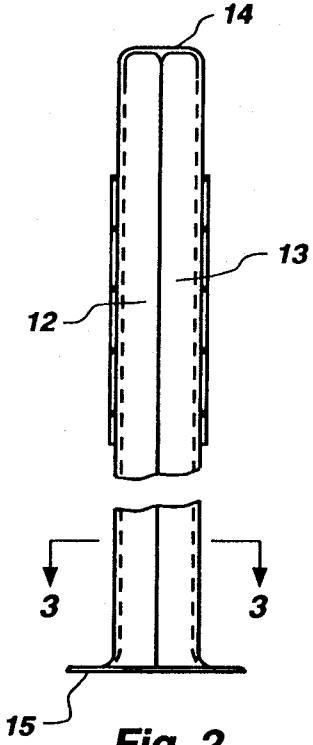
FIG. 2 is an edge, elevational view of the flanged, light-blocking device of FIG. 1.
Figure 3:
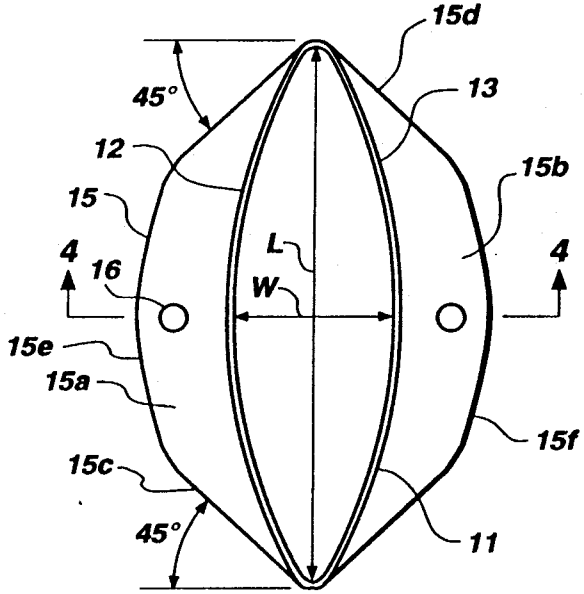
FIG. 3 is a plan, cross-sectional view of the flanged, light-blocking device of FIG. 2 along section lines "B—B;"

A preferred embodiment of a light-blocking device of this invention is illustrated in FIGS. 1, 2 and 3. An elevational front view of the hollow, tubular device 10 is shown in FIG. 1 as an elongated, hollow tube 11 with a broad, light-blocking face 12. The tube has a substantially uniform width over its entire height and has a substantially elliptical (aerodynamic) lateral cross-sectional shape.

An elevational (side) view of the device 10 is illustrated in FIG. 2. Both the front face 12 and rear face 13 are illustrated as well as the smooth, closed top 14. A flat flange 15 is an integral part of the base of the tube.

A cross-sectional view of the device 10 along section lines B—B is shown in FIG. 3. The flange 15 is continuous with each face, forming a left flange 15*a* along the base of face 12 and a right flange 15*b* along the base of face 13, thereby substantially circumscribing the base of the hollow tubular device.

The flange 15 has a substantially elliptical shape somewhat similar to that of the hollow tubular member 11. The width (w) of flange 15*a* is at least one-third, and preferably one-half or more, of the hollow, tubular member 11. A typical maximum width for one side of the flange is from about one to about two inches and preferably about 1.4 inches. A typical width for the tubular member 11 is from about two to about four inches. A typical lateral, cross-sectional length (1) is from about six inches, preferably about eight inches, up to about nine to ten inches. The length is typically about eight and one-half inches which is almost the diagonal length of the top surface of a typical concrete median barrier having a width of about six inches. The height of the tubular member is preferably from about two to about four feet. A bolt hole 16 is positioned at a midpoint on flange member 15*a* while a directly opposed bolt hole 17 is in flange member 15*b*. The edges 15*c* and 15*d* adjacent the thin edges of the hollow tube are each constructed to be at an angle of 45° to the cross-sectional longitudinal axis of the tubular member 11.

The mid-sections 15*e* and 15*f* of flange 15 are curved along lines which give the flange an elliptical shape similar to the elliptical shape of the hollow tubular member 11. The bolt holes 16 and 17 are at least about one-half inch, preferably at least ⅝ inch, from the outer curved edges 15*e* and 15*f* of the flange. The curved intersection between the tube face and the flange assists in energy-absorption when the tube is impacted by a force and further assists the tube in rebounding after being struck to a vertical orientation.

Figure 4:
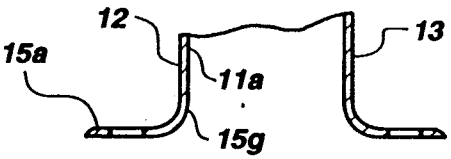
FIG. 4 is an elevational, cross-sectional view of the flanged, light-blocking device of FIG. 3 along section lines "C—C;"

A cross-sectional, elevation view along section lines C—C of FIG. 3 of the base of the tubular member 11 is illustrated in FIG. 4. The thickness of the tube wall is about 0.06 to about 0.25 inch and preferably about 0.10 inch. The tube wall 11*a* curves into the flange 15*a*. The curve 15*g* is defined by a short radius, e.g. 0.25 inch.

Figure 5:
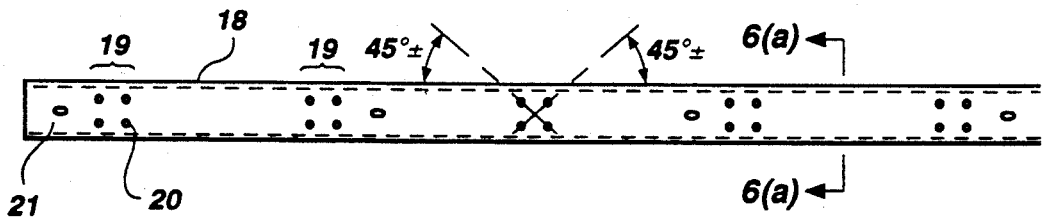
FIG. 5 is a plan view of a base runner suitable for having attached to it a group of spaced, individual light-blocking, devices of FIG. 1 to a highway barrier.
Figure 6A:
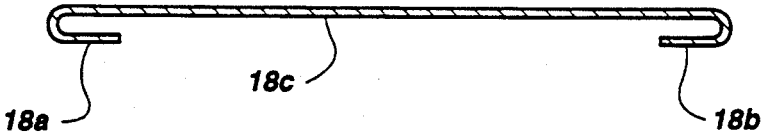
FIG. 6(*a*) is an elevational, end-view of the base runner of FIG. 5.
Figure 6B:
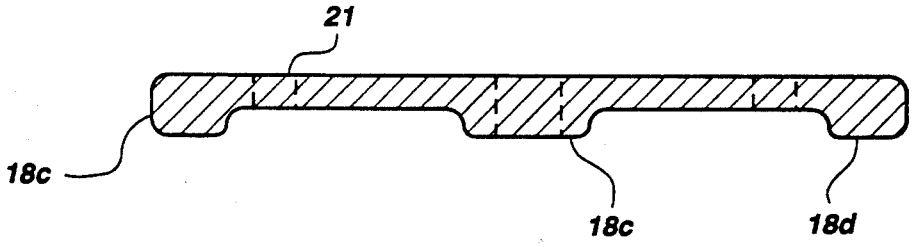

FIG. 5, a plan view, and FIG. 6, an elevational view, illustrate a base runner 18 which is a long, narrow metal strip having uniformly spaced groups 19 of bolt holes 20. Each individual bolt hole 20 preferably is square in shape to accommodate a carriage bolt, which has a square shank between the bolt head and the threads. Thus, a carriage bolt in position through the base runner is secure in place and need not be held by a wrench when screwing on a nut. Thus, if a light-blocking device should be dislodged, a new device can be secured in place without removing the base runner from the concrete median barrier to which it is attached.

The four bolt holes 20 in a group 19 are positioned at the four corners of a square wherein the distance between bolt holes on diagonally opposed corners is the same as the distance between the pair of bolt holes 16 and 17 in the flange of the light-blocking device. The bolt holes on one side of a group are parallel to the longitudinal axis of the base runner. Aligning the bolt holes 16 and 17 of the flange of a light-blocking device 10 with diagonally opposed bolt holes in the base runner positions the device 10 with its cross-sectional longitudinal axis at an angle of 45° to the longitudinal axis of the base runner (see FIG. 8). Switching the flange bolt holes from one pair of diagonal holes of a group to the other pair of diagonal holes switches the light-blocking device from an orientation to block light from a right to left utilization i.e. one where oncoming traffic is passing a driver on the left to one where traffic is passing on the right.

The base runner 18 is attachable to a concrete median barrier by bolts through slotted bolt holes 21. These slotted bolt holes 21 are spaced along the base runner 18, generally uniformly spaced. A base runner having a preferred length of about 9'8" has four groups of slotted bolt holes spaced one and one-half feet to about three feet apart. The groups 19 of bolt holes 20 are preferably spaced about two feet apart for a device having a cross-sectional length of between about eight and nine inches. The base runner may be any convenient length and is especially about the length of concrete modular barriers in current use.

FIG. 6 illustrates an end, elevational view wherein the side margins 18*a* and 18*b* of the runner have been bent over an arc of 180° to form a pair of elongated feet extending along each side of the base runner for its entire length, said feet resting upon the top surface of a concrete median barrier to space the lower surface 18*c* of the base runner from the top surface of the concrete median barrier a sufficient distance to provide space for the bolt heads of the carriage bolts which hold in place the light-blocking device and to compensate for the uneven top surface of the concrete barriers with which it is used. The width of such base runner is preferably about six inches. The base runner illustrated in FIGS. 5 and 6(*a*) is a metal runner, although plastic or FGRP runners may be utilized wherein the margins of the runner are thicker than the middle of the runner to provide bolt head space.

FIG. 6(*b*) illustrates a FGRP base runner which has a plan view similar to FIG. 5. The FGRP base runner is thicker along its lateral margins 18*c* and 18*d* so that elongated central portions are raised or elevated a sufficient distance to accommodate the head of a carriage bolt. The top surface of the FGRP base runner is preferably flat, i.e. planar. A thickened ridge 18*e* preferably runs along the central longitudinal axes of the runner to provide good support for the slotted bolt hole 21 and to provide a central bearing surface to contact the top surface of a median barrier to which it is attached.

Figure 7:
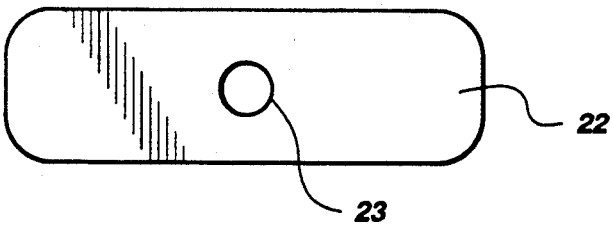
FIG. 7 is a plan view of an elongated washer used in connection with the flange member of a light-blocking device of the type illustrated in FIG. 1.

FIG. 7 illustrates a preferred bearing washer 22 which is substantially rectangular with a length which is preferably about three times it width. A preferred length is about three inches while its width is about one inch. The washer is essentially flat with a bolt hole 23 preferably located at the geometric center of the washer. The thickness is about 0.25 inches while the material is preferably steel although other strong, tough material could be used.

Washer 22 is sized to present a larger bearing surface to grip a significant area of the flange between the washer and the base runner or concrete median barrier if the light-blocking devices are used without a base runner. When a large area of the flange is thus tightly gripped, it diminishes the tearing forces on the bolt hole in the flange and also tends to stabilize the light-blocking device when it is struck by an object or buffeted by the wind.

Round or oval washers could also be used, consistent with a large bearing area being preferred.

Figure 8:
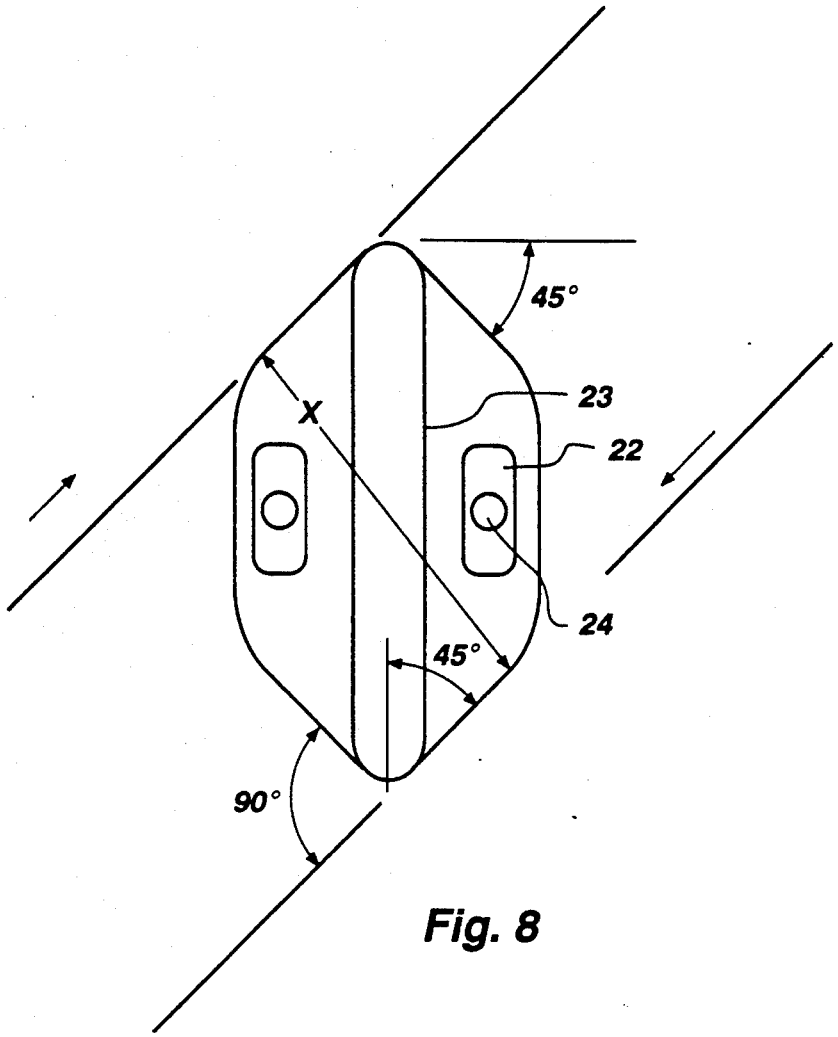
FIG. 8 is a plan view of a flanged, light-blocking, hollow tubular device having a narrow, oval (oblate) cross-section attached to an elongated base runner.
Figure 9:
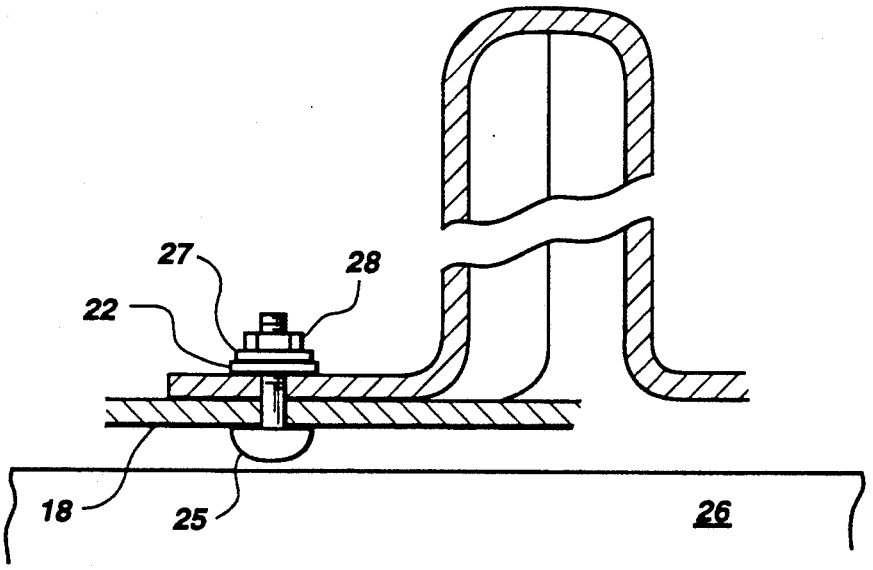
FIG. 9 is an elevational, partial cross-sectional view illustrating the attachment of a flanged, light-blocking device to an elongated base runner.

The manner of attaching a light-blocking device to a base runner or concrete median barrier is illustrated in FIGS. 8 and 9. A plan view of a light-blocking device with a tube member 23 having a race track (oval) shape and a substantially elliptically-shaped flange is shown in FIG. 8. The aerodynamic cross-sectional shape of the tube member is preferred (see FIGS. 1-3); however, other cross-sectional configurations wherein the major axis is much greater than the minor axis may be used. A washer 22 and bolt 2 are used to attach the flange to a base runner. As can be seen from FIG. 8, the transverse distance (opposed straight edges) "x" of the flange is about the same as the width of the base runner. The longitudinal axis of the tube member 23 is at a 45° angle to the parallel, longitudinal edges of the base runner.

Although a different bolt hole arrangement on the flange may be used, it is preferred that opposed bolt holes be at the widest part of the flange and substantially aligned with the mid-point of the faces of the tube member. While an arrangement of four holes in the flange and four holes in the base runner arranged in a diamond pattern could be used, the illustrated arrangement is preferred.

As illustrated in FIG. 8, the flange is shaped and dimensioned to place a maximum area of flange on the base runner without any significant overlapping of the flange over the sides of the base runner.

FIG. 9 is a cross-sectioned, elevational view of a light-blocking device attached to a base runner. The base runner 18 may be metal (FIG. 6(*a*)) or FGRP (FIG. 6(*b*)) through which a carriage bolt 25 passes. The square shank of the carriage bolt and the square shape of the hole prevent the bolt from rotating when a nut is threaded onto it. The limited space between the bottom of the base runner and the top surface of the median barrier 26 precludes the bolt from being dislodged. The large bearing washer 22 is preferably held in place by a lock washer 27 and a nut 28, although a locking nut may be used to replace the lock washer.

Figure 10:
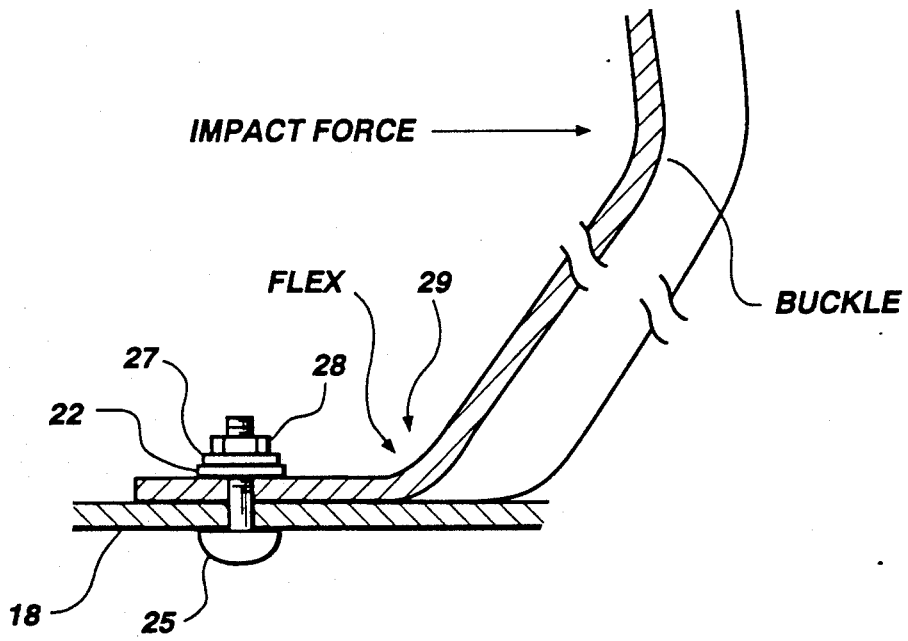
FIG. 10 is an elevational, cross-sectional view of a light-blocking device of FIG. 1 reacting to a sudden lateral force striking the device.

FIG. 10 is a cross-sectional, elevational view of a light-blocking device of the instant invention showing the tube member being impacted by a localized force. The force causes the tube to buckle at point of impact and to flex at the junction 29 between the tube and the flange. The buckling of the tube and flexing at the tube-flange junction tends to absorb significant energy created by the force impact. Very little tearing force is transmitted to the bolt hole of the flange and that which is so transmitted is spread over a large area by the gripping force of the bearing washer. The tube and flange will gradually rebound to a normal vertical position. If the impacting force is very large, the device may take several hours and even up to a day or so to completely return to its original shape and vertical orientation.

Figure 11:
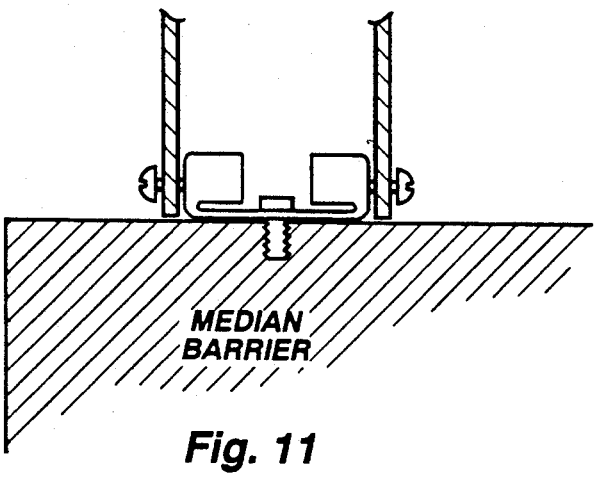
FIG. 11 is an elevational, cross-sectional view of a prior art light-blocking device of the type disclosed in the Syak patent and its L-shaped metal attachment device.
Figure 12:
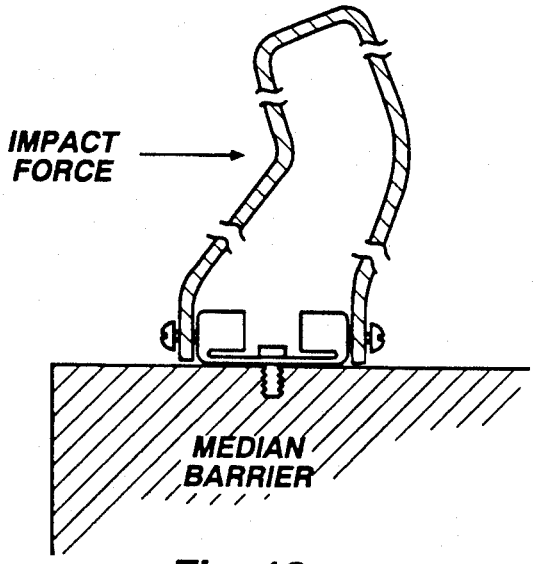
FIG. 12 is an elevational, cross-sectional view of the light-blocking device of FIG. 11 reacting to a sudden lateral force striking the device.
Figure 13:
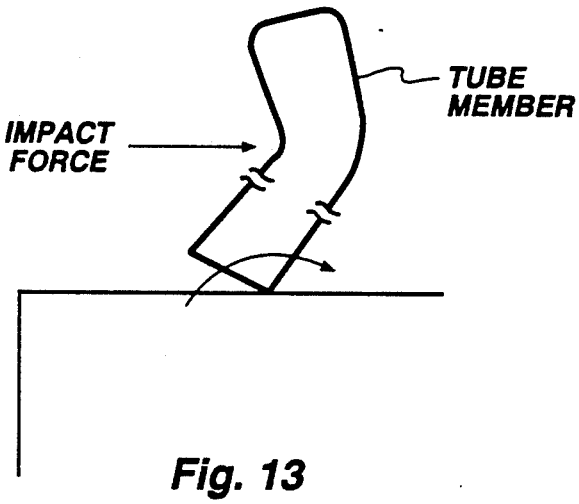
FIG. 13 is an elevational view of the light-blocking device of FIG. 11 illustrating the moment forces created at the base of the device by a sudden lateral force striking the device.

FIGS. 11, 12 and 13 illustrate the attachment arrangement (FIG. 11) for a tubular light-blocking device of the prior art type (see Syak patent) and the effect of a force impacting the tube. The tube member is attached to a support (concrete median barrier) by an internal metal bracket having the shape of an inverted cup with upright sides having a substantially elliptical shape to conform generally to the interior shape of the tube. The tube is attached to the bracket by a pair of bolts on each side of the tube. The impact of the force is such that the tube tends to rotate about its lower end (FIG. 13) and to cause a tearing stress (see FIG. 12) on the bolt holes. The internal metal, cup-shaped bracket tends not to bend. The wing or tab members of the upright position of the bracket project forward (as shown in FIGS. 11 and 12) and thus prevent the upright portion to which the tube is attached from bending forward. Thus, all the stress at the lower end of the tube results in a tearing action on the bolt holes.

Preferred materials for the flanged tube include low density polyethylene with a 2,000 psi tensile strength (test procedures as per ASTM D-638), high density polyethylene, high density polyethylene with EVA flexibilizer to increase flexibility, high molecular weight, high density polyethylene, polypropylene, polyurethane, polyvinyl chloride (PVC) and the like.

Preferred materials for the base runner are steel, fiber-glass reinforced plastic (FGRP) wherein the plastic is a polyester, epoxy or other thermoset plastic or a thermplastic material, such as polyethylene, polypropylene, PVC or the like which may be formed by extrusion or pultrusion.

The vision blocking devices of this invention may be installed individually or as a group of elements attached to a base runner. When installed individually the flanged tube is attached to a threaded stud secured in a median barrier or by bolting it into the barrier which is generally concrete.

Installation of a group of flanged tubes involves bolting a base runner to a concrete barrier with the carriage bolts in the base runner in selected diagonal holes selected to give the flanged tube the desired diagonal orientation. The correct diagonal orientation will depend on whether the oncoming traffic is to the left or right of a driver.

Once the base runner is attached to a median, the flanged light blocking elements can be attached to the projecting carriage bolts.

The invention described herein is very advantageous in that it is an economical system which is quick and easy to install. It provides an aesthetic appearance with light blocking elements which are relatively stable when buffeted by breezes created by passing vehicles. Also, the system effectively reduces glare with blunt-ended tubes which do not present a safety hazard if dislodged. Further, the construction of the flanged tubes and fastening system is such that they are not easily deformed: holding their shape and verticality even when struck by objects protruding from passing vehicles. The rebound characteristics are quite good so that any distorted elements rebound to their original shape and verticality within about twenty-four hours. Prior systems did not possess these advantages.

I claim:

1. A light- (vision) blocking device vertically oriented for attachment to a median between traffic lanes comprising:

an elongated, semi-rigid, hollow plastic tube substantially elliptically shaped in lateral cross-section;

an integral flange member substantially circumscribing the open end of said tube, said flange flaring substantially perpendicularly to the side walls of said tube and having a width sufficiently great to support the tube in a vertical position and to accommodate attachment means for attaching said blade to a support member, said flange being adapted to mount said blade in an upright position.

2. The light-blocking device of claim 1, wherein said flange has a substantially elliptical shape.

3. The light blocking device of claim 2, wherein the width of said flange is at least about one-third the width of said tube.

4. The light-blocking device of claim 1, wherein said flange is adapted to be secured to a highway barrier by a maximum of two fastening means.

5. The light-blocking device of claim 1 wherein said flange is integral with said tube.

6. The light-blocking device of claim 1 wherein said tube has a closed end and an open end adjacent said flange.

7. The light-blocking device of claim 1 wherein said tube has a length which is at least about twice its width.

8. The light-blocking device of claim 1 wherein said tube has a height of about two to about four feet.

9. The light-blocking device of claim 7 wherein said tube has a width which is at least about two inches.

10. A light-blocking modular system for mounting atop temporary concrete median barriers comprising:

an elongated, substantially flat, substantially rigid, thin runner structured to be attached to the top surface of a temporary concrete barrier, said runner having a plurality of groupings of bolt holes, each of said groupings consisting of four bolt holes clustered geometrically at the corner of a square, with the sides of said square substantially parallel and perpendicular to the elongated edge of said rigid strip; and a plurality of elongated hollow plastic tubular elements each having an integral flange circumscribing one end, said flange structured to be attached directly to said elongated rigid strip.

11. The light-blocking modular system of claim 10 wherein said rigid strip is a metal strip.

12. The light-blocking modular system of claim 11 wherein said metal strip is a galvanized steel strip.

13. The light-blocking modular system of claim 10 wherein said rigid strip is plastic.

14. The light-blocking modular system of claim 13 wherein said plastic strip is fiber glass reinforced plastic.

15. The light-blocking modular system of claim 10 wherein said flange has a single pair of bolt holes in said flange on opposite sides of said tubular member.

16. The light-blocking modular system of claim 13 wherein said flange is attached to said runner by a pair of bolts through bolt holes diametrically opposed to one another.

* * * * *